US009038317B2

(12) United States Patent
Hansen

(10) Patent No.: US 9,038,317 B2
(45) Date of Patent: May 26, 2015

(54) RESIDENTIAL WINDOW POWER ACTUATOR

(71) Applicant: Strattec Power Access LLC, Troy, MI (US)

(72) Inventor: Eric Hansen, Lake Orion, MI (US)

(73) Assignee: STRATTEC POWER ACCESS LLC, Troy, MI (US)

( * ) Notice: Subject to any disclaimer, the term of this patent is extended or adjusted under 35 U.S.C. 154(b) by 0 days.

(21) Appl. No.: 13/902,029

(22) Filed: May 24, 2013

(65) Prior Publication Data

US 2013/0318875 A1 Dec. 5, 2013

Related U.S. Application Data

(60) Provisional application No. 61/651,701, filed on May 25, 2012.

(51) Int. Cl.

| | |
|---|---|
| ***E05F 11/00*** | (2006.01) |
| ***E05F 15/16*** | (2006.01) |
| *E05F 11/48* | (2006.01) |

(52) U.S. Cl.

CPC ..... *E05F 15/16* (2013.01); *E05F 15/665* (2015.01); *E05F 11/48* (2013.01); *E05F 15/40* (2015.01); *E05F 15/71* (2015.01); *E05F 15/77* (2015.01); *E05F 15/79* (2015.01)

(58) Field of Classification Search

CPC ..... E05F 15/16; E05F 15/665; E05F 15/71; E05F 15/77; E05F 11/48

USPC ..... 49/360, 116, 123

See application file for complete search history.

(56) References Cited

U.S. PATENT DOCUMENTS

| | | | | | |
|---|---|---|---|---|---|
| 860,518 | A | * | 7/1907 | Best | 49/136 |
| 906,749 | A | * | 12/1908 | Strong | 49/98 |
| 1,919,671 | A | * | 7/1933 | Shetzline | 49/360 |
| 2,067,106 | A | | 1/1937 | Tashjian et al. | |
| 2,501,092 | A | * | 3/1950 | Rappl | 49/349 |
| 2,636,727 | A | | 4/1953 | Toth | |
| 2,979,328 | A | * | 4/1961 | Henrikson | 49/361 |
| 3,261,113 | A | * | 7/1966 | March | 434/420 |
| 3,691,684 | A | | 9/1972 | Bonek | |
| 4,083,149 | A | * | 4/1978 | Hickman et al. | 49/147 |
| 4,237,654 | A | * | 12/1980 | Landem et al. | 49/141 |
| 5,144,770 | A | | 9/1992 | Kraus et al. | |
| 5,237,777 | A | * | 8/1993 | Houston et al. | 49/360 |
| 5,249,392 | A | * | 10/1993 | Houston et al. | 49/360 |
| 5,271,183 | A | * | 12/1993 | Hahn et al. | 49/360 |
| 5,435,101 | A | | 7/1995 | Garries | |
| 5,440,837 | A | | 8/1995 | Piltingsrud | |
| 5,449,987 | A | | 9/1995 | McMillan | |
| 5,502,925 | A | | 4/1996 | Gorrell | |
| 5,595,026 | A | * | 1/1997 | Licking et al. | 49/360 |
| 5,617,675 | A | * | 4/1997 | Kobrehel | 49/352 |
| 5,784,831 | A | * | 7/1998 | Licking | 49/141 |
| 5,806,245 | A | * | 9/1998 | Satrom | 49/360 |

(Continued)

*Primary Examiner* — Jerry Redman

(74) *Attorney, Agent, or Firm* — Michael Best & Friedrich LLP

(57) ABSTRACT

A power actuator for a window in a building includes a drive unit, a cable system, and a controller. The drive unit is positioned within a sill of the window. The cable system is engagable with the drive unit for moving a pane of the window relative to a window frame between an opened position and a closed position. The controller is electrically coupled to the drive unit and a power outlet located in the building and connected to an external power grid.

13 Claims, 6 Drawing Sheets

(56) References Cited

U.S. PATENT DOCUMENTS

| | | | | |
|---|---|---|---|---|
| 5,839,230 | A * | 11/1998 | Licking et al. | 49/360 |
| 6,139,070 | A | 10/2000 | Piltingsrud | |
| 6,148,700 | A | 11/2000 | Upholz | |
| 6,658,793 | B2 * | 12/2003 | Perron | 49/123 |
| 6,701,670 | B2 * | 3/2004 | Evans | 49/123 |
| 7,117,636 | B2 * | 10/2006 | Gann | 49/123 |
| 2003/0110697 | A1 * | 6/2003 | Perron | 49/123 |
| 2005/0055881 | A1 * | 3/2005 | Gann | 49/123 |
| 2007/0011946 | A1 | 1/2007 | Mullen et al. | |
| 2010/0116219 | A1 | 5/2010 | Noyes | |
| 2012/0199294 | A1 * | 8/2012 | Fayette et al. | 160/99 |

* cited by examiner

RESIDENTIAL WINDOW POWER ACTUATOR

CROSS-REFERENCE TO RELATED APPLICATIONS

This application claims priority to U.S. Provisional Patent Application No. 61/651,701 filed May 25, 2012, the entire contents of which is incorporated herein by reference.

FIELD OF THE INVENTION

The present invention relates to windows, and more particularly to residential windows that are power operated.

BACKGROUND

The present invention relates to windows of residential and commercial buildings, more particularly to such windows that may be opened or closed. Specifically, the invention relates to power actuators for said windows.

Windows that are openable, such as double hung windows in residential buildings, are traditionally manually operated. Double hung windows can be large and heavy, and thus can be difficult to open and close. In addition, some windows are not easily accessible due to their location in the building and/or the placement of furniture in front of the windows.

SUMMARY

The invention provides, in one aspect, a power actuator for a window in a building. The power actuator includes a drive unit, a cable system, and a controller. The drive unit is positioned within a sill of the window. The cable system is engagable with the drive unit for moving a pane of the window relative to a window frame between an opened position and a closed position. The controller is electrically coupled to the drive unit and a power outlet located in the building and connected to an external power grid.

The invention provides, in another aspect, a power window assembly including a window, a pulley, and a cable system. The window has a sash movable between an opened position and a closed position, and the pulley is fixed to a frame of the window. The cable system includes a cable engagable with the pulley and extending in a length direction at least a portion of a distance between the sash and a sill of the window. The cable is rotatable to move the sash between the open and closed positions.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
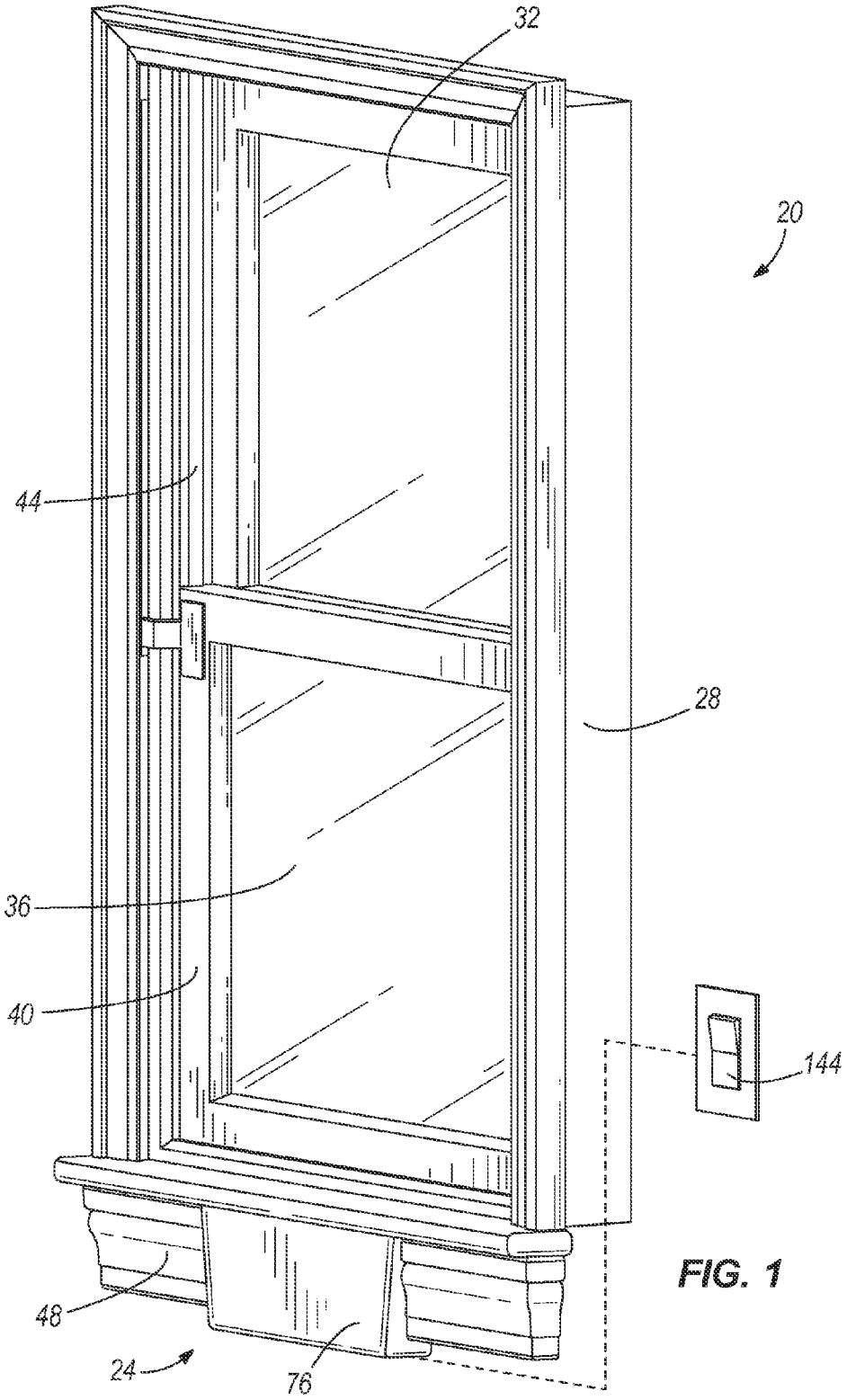
FIG. 1 is a perspective view of a window and a window power actuator.

A power window assembly or single hung window 20 and window power actuator 24 are illustrated in FIG. 1. A single hung window 20 includes a frame 28, a fixed glass pane 32, a movable glass pane 36, a sash 40, tracks 44, and a sill 48. The frame 28 is coupled to a wall of a building and provides support for the other portions of the window 20. The fixed glass pane 32 is held in place by the frame 28. The moveable glass pane 36 is held in place by the sash 40. Tracks 44 are disposed on the frame 28 and serve to guide the sash 40. The sash 40 is moveable relative to the window frame 28 in an up and down direction to open and close the sash 40, and consequently the movable glass pane 36. A sill 48 is disposed at the bottom of the frame 28. The illustrated embodiments show the window power actuator 24 being used with a single hung window 20, but it is within the scope of this invention to use the window power actuator 24 with double hung windows, windows that are fixed in one plane, windows that may be tilted out the track, horizontal sliding windows, other windows that may be open and closed, and various combinations of the aforementioned windows. It is to be understood that the term "window" denotes any type of window for a building that may be opened and closed.

Figure 2:
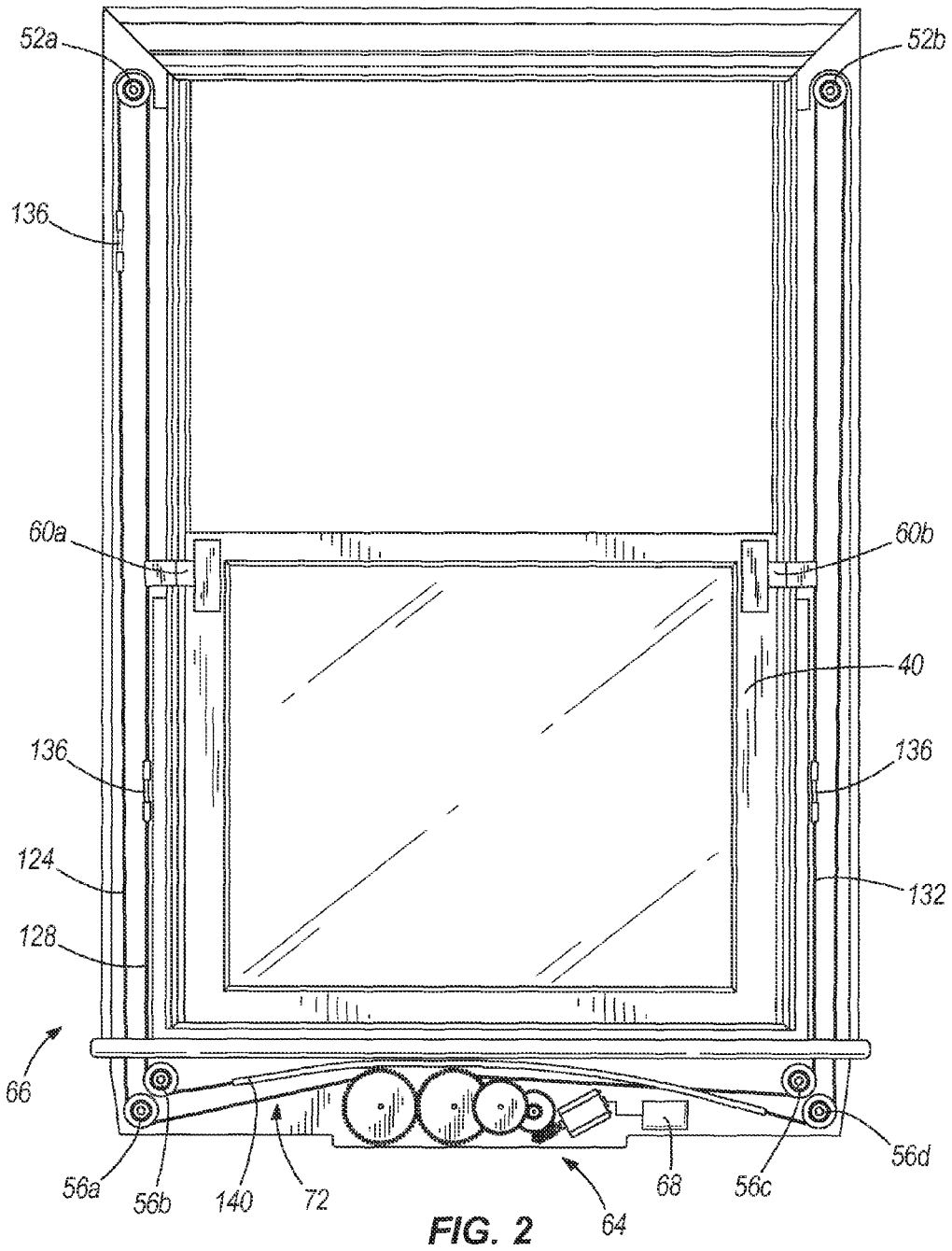
FIG. 2 is a cut-away section view of the window and window power actuator of FIG. 1.

The window power actuator 24, shown in FIG. 2, includes upper pulleys 52, lower pulleys 56, brackets 60, a drive unit 64, a first cable 124, a second cable 128 and a third cable 132 which comprise a cable system 66, and a control unit or controller 68. At least a portion of each cable 124, 128, 132 extends in a length direction of at least a portion of a distance between the drive unit 64 and/or sill 48 and the movable glass pane 36 and/or sash 40. In the illustrated embodiment, as seen in FIG. 1, the window power actuator 24 is disposed or positioned in an interior space 72 within the frame 28 and sill 48 of the window 20 and thus is not visible when installed. At least one covering 76 provides access to the window power actuator 24. In other embodiments, the window 20 may also include an opening located in the sill 48 or frame 28, in which a removable panel may be positioned within the opening and through which the controller 68 is electrically coupled to a wall switch 144 and/or power outlet of the building. In still other embodiments, the window 20 may include one or more openings through which the controller 68 is electrically coupled to the wall switch 144 and/or power outlet of the building.

In some embodiments the window power actuator 24 is not disposed inside of the frame 28 and sill 48, but rather, is coupled to the frame 28 and/or sill 48. In these other embodiments the window power actuator 24 may be concealed using one or more coverings 76 that are coupled to the window frame 28 and/or sill 48. Thus the window power actuator 24 may be included with the window 20 when the window 20 is manufactured. In other embodiments the window power actuator 24 may be retrofitted to an already existing and installed window 20. In yet other embodiments the window power actuator 24 is installed when a window 20 is replaced in a building.

The upper pulleys 52 are coupled, fixed or attached to the frame 28, as seen in FIG. 2. The upper pulleys 52 may be coupled to the frame using a nail, screw, bolt, or the like. One upper pulley 52*a* is coupled to the left hand side of the frame, while another upper pulley 52*b* is coupled to the right hand side of the frame 28. The upper pulleys 52 are sized and configured to allow a portion of the cable system 66 to rotate around the pulley, while inhibiting the portion of the cable system 66 from sliding off the pulley. In one embodiment a bearing is disposed in the center of the pulley 52 to assist the pulley 52 in turning smoothly and to ensure maintenance-free operation.

The illustrated embodiment includes four lower pulleys 56, as seen in FIG. 2. A left-most lower pulley 56*a* and left-raised lower pulley 56*b* are coupled, fixed or attached to the left hand side of the sill 48, and a right-raised lower pulley 56*c* and right-most lower pulley 56*d* are coupled, fixed or attached to the right hand side of the sill 48. In an alternative embodiment at least one of the lower pulleys 56 is coupled to the frame 28. In the illustrated embodiment the lower pulleys 56 are similar in size and design to the upper pulleys 52, while in other embodiments the lower pulleys 56 may be of a different size and/or design. In some embodiments, an idler pulley can be disposed between the left-most lower pulley 56*a* and the drive unit 64. In still other embodiments, more or less idler pulleys may be used.

Figure 4:
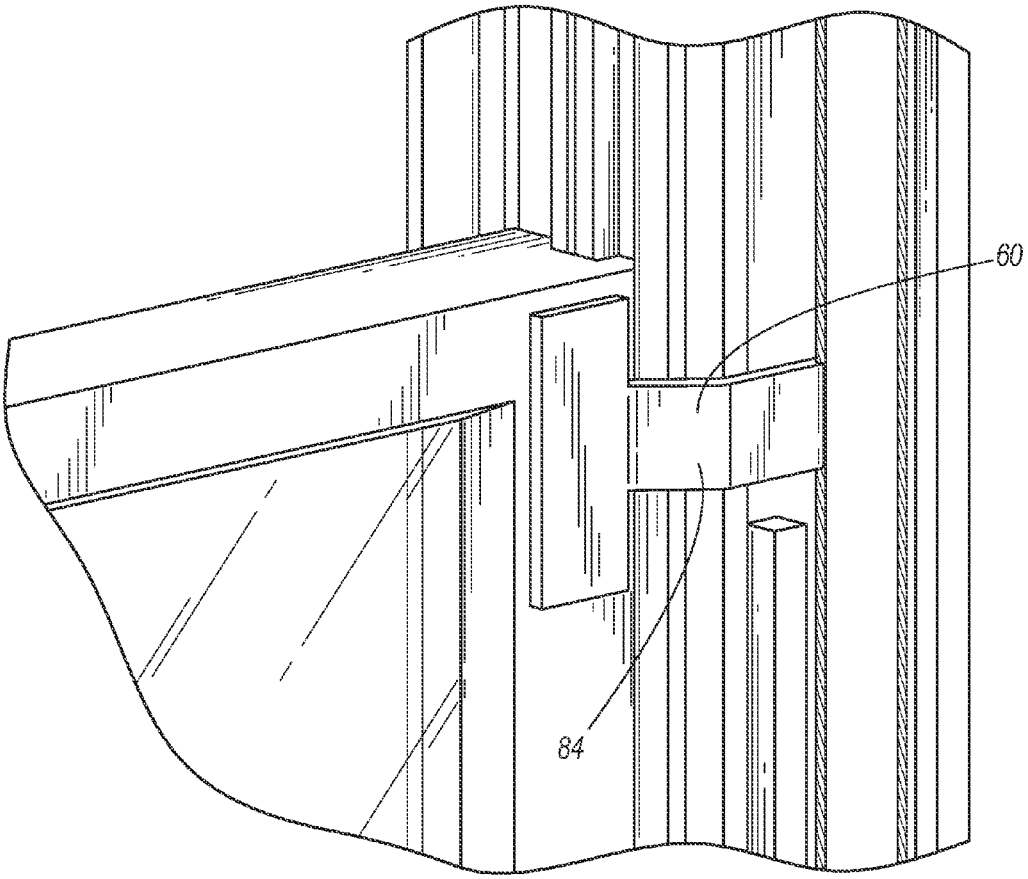
FIG. 4 is a perspective view of the window of FIG. 1 and a bracket of the window power actuator of FIG. 1.

The window power actuator 24 uses two brackets 60 for a single hung window 20, as shown in FIG. 1. One bracket 60*a* is coupled to the left side of the sash 40, while another bracket 60*b* is coupled to the right side of the sash 40. The brackets 60 may be coupled to the sash 40 by screws, nails, or the like, and/or the brackets 60 may be coupled to the sash 40 using an adhesive. As best seen in FIG. 4, the bracket 60 may include an angled portion 84 in order to allow the sash 40 to be coupled to the cable system 66 when the cable system 66 is offset from the bracket 60. In other embodiments the angled portion 84 is not included because the sash 40 and the cable system 66 are not offset. The brackets 60 are coupled to the cable system 66 by crimping or press fitting.

Figure 3:
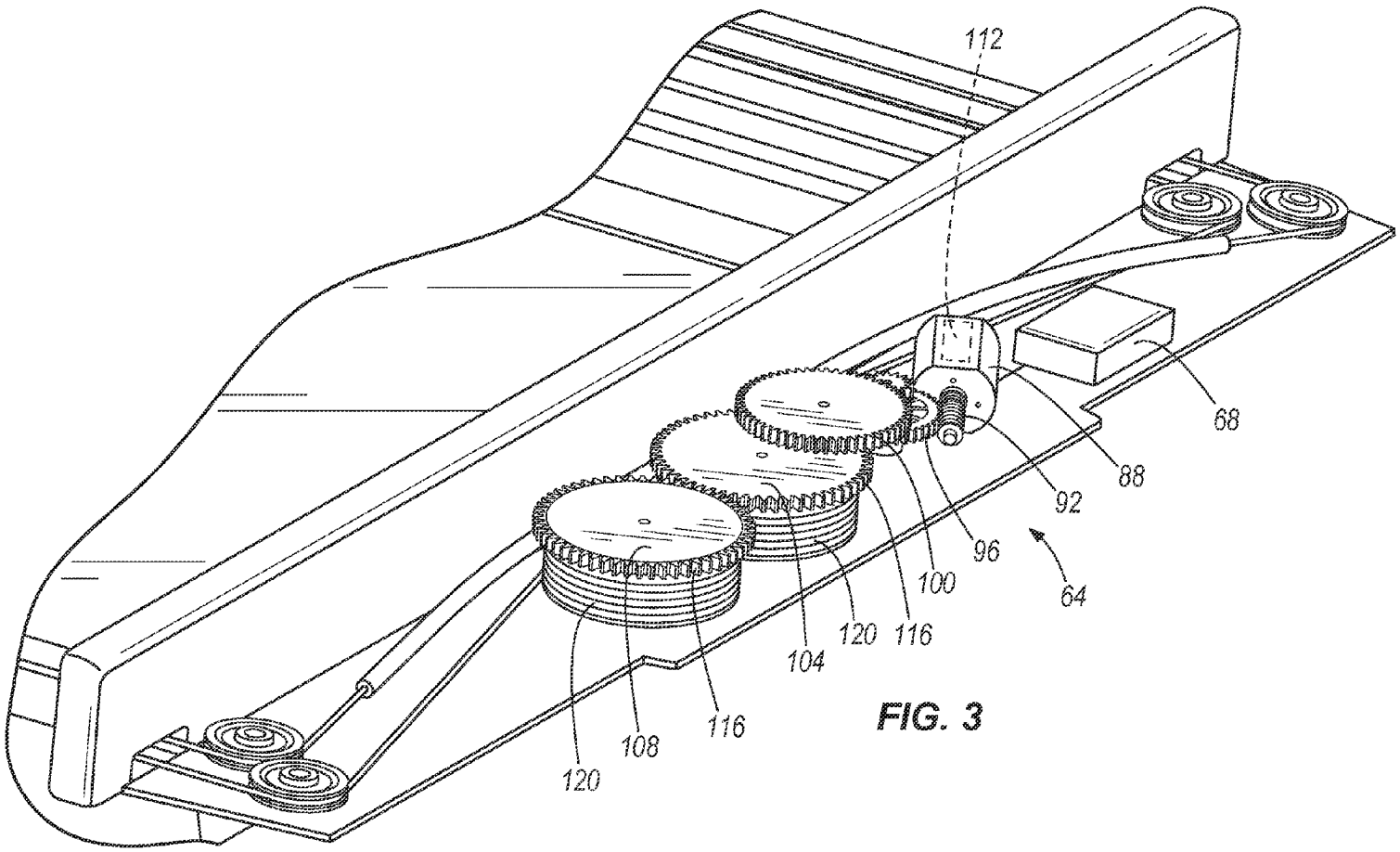
FIG. 3 is a cut-away perspective view of a drive unit of the window power actuator of FIG. 1.

The drive unit 64, illustrated in FIG. 3, is engagable with the cable system 66 and includes a motor 88, a worm gear 92, a spur gear 96, a series of gears 100, a first drum 104 and a second drum 108. In the illustrated embodiment the drive unit 64 is coupled to the sill 48, but in an alternative embodiment the drive unit 64 is coupled to the frame 28. The motor 88 in the illustrated embodiment is an alternating current electric motor that is capable of being driven in two directions. In an alternative embodiment the motor 88 is a direct current electric motor. A Hall effect sensor 112 is disposed in an interior portion of the motor 88 to measure the rotational speed of the motor 88. The worm gear 92 is coupled to motor 88 and turns as the motor 88 turns. The worm gear 92 interfaces with the spur gear 96 in order to turn the spur gear 96. In the illustrated embodiment the series of gears 100 are disposed between the spur gear 96 and the first drum 104 such that as the spur gear 96 is driven, the series of gears 100 are driven, and the first and second drums 104, 108 are driven. The first and second drums 104, 108 each include a spur gear portion 116 and a cable winding portion 120. The cable winding portions 120 of the first and second drums 104, 108 are disposed so that they are in approximately the same plane as the lower pulleys 56.

The cable winding portion 120 of the first drum 104 is configured such that the third cable 132 is rotated or wound onto the first drum 104 when the first drum 104 is turned in a first direction, and the third cable 132 is unwound from the first drum 104 when it is turned in a second direction, the second direction being opposite from the first direction. The cable winding portion 120 of the second drum 108 is configured such that the first cable 124 is rotated or wound onto the second drum 108 when the second drum 104 is turned in the second direction, and the first cable 124 is unwound from the second drum 104 when it is turned in the first direction. The spur gear portions 116 of the first and second drums 104, 108 are the same size such that the first and second drums 104, 108 turn at the same rate. The first and second drums 104, 108 are disposed next to one another such that the first and second drums 104, 108 turn in opposite directions. The matched turning rates of the first and second drums 104, 108 assist in maintaining tension in the cable system 66.

Figure 3A:
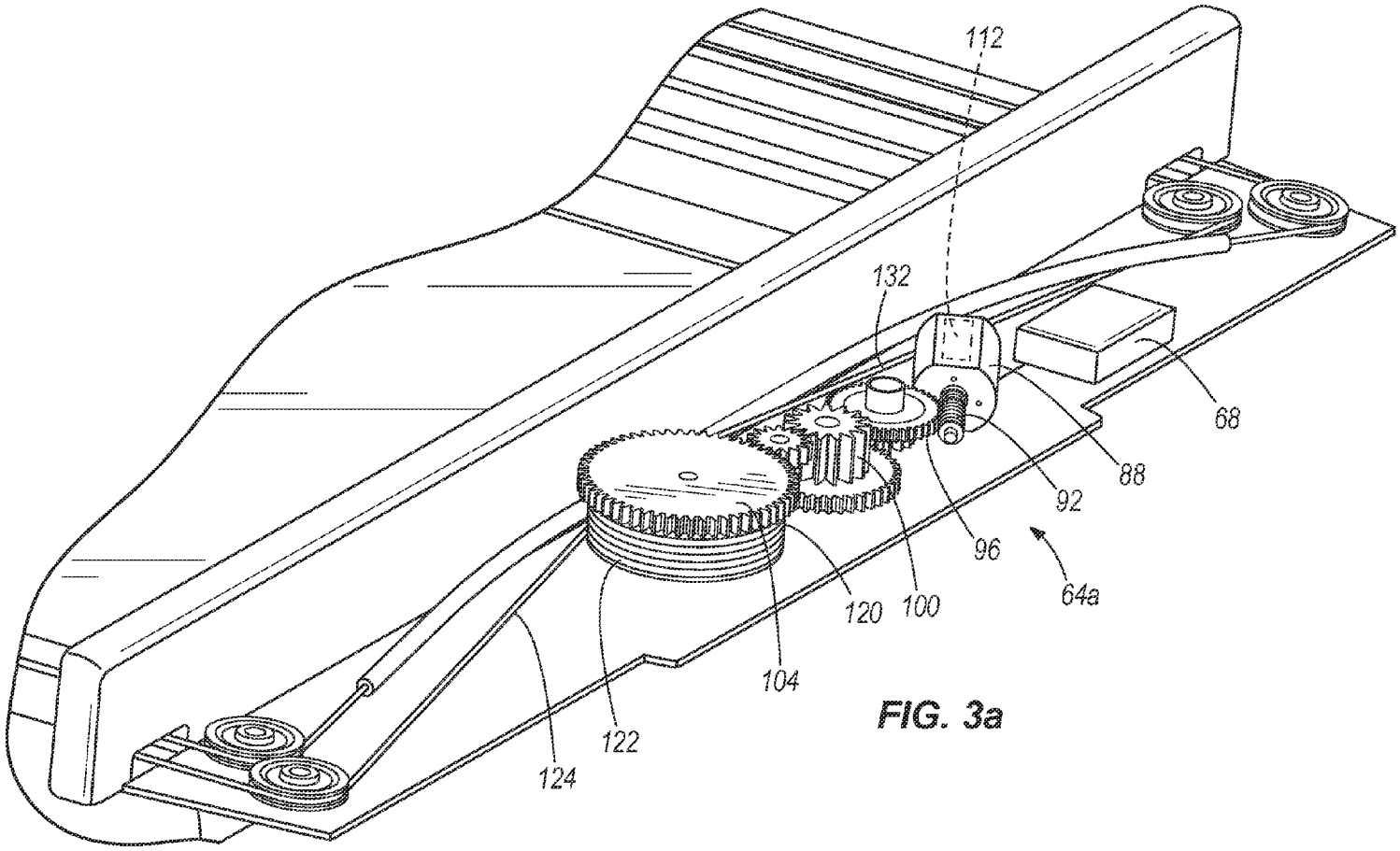
FIG. 3*a* is a cut-away perspective view of an alternative embodiment of a drive unit of the window power actuator of FIG. 1.

An alternative embodiment of the drive unit 64*a*, illustrated in FIG. 3*a*, is similar to the previously described drive unit 64, but only includes the first drum 104. Only the differences between the alternative embodiment of the drive unit 64*a* and the drive unit 64 will be described. The first drum 104 includes the cable winding portion 120 and a cable unwinding portion 122. The first cable 124 is wound or unwound onto the cable winding portion 120. The third cable 132 is wound or unwound onto the cable unwinding portion 122. When the first drum 104 rotates in the first direction, the first cable 124 is wound onto the cable winding portion 120 and the third cable 132 is unwound from the cable unwinding portion 122. When the first drum 104 rotates in the second direction, the first cable 124 is unwound from the cable winding portion 120 and the third cable 132 is wound onto the cable unwinding portion 122. The simultaneous winding and unwinding of the first and third cables 124, 132 assists in maintaining tension in the cable system 66.

The cable system 66 in the illustrated embodiment includes the first cable 124, the second cable 128, and the third cable 132 and three turn buckles 136. A portion of each cable 124, 128, 132 is engagable with and/or rotatable around an upper pulley 56 and/or lower pulley 52. The first cable 124 is coupled to the second drum 108, is routed or rotated around the left-most lower pulley 56*a*, is then routed or rotated around the left upper pulley 52*a*, and is then coupled to the left bracket 60*a*. The turn buckle 136 is disposed in the first cable 124 between the left-most lower pulley 56*a* and the left upper pulley 52*a*. The second cable 128 is coupled to the left bracket 60*a*, is then routed or rotated around the left-raised lower pulley 56*b*, passes through a sheath 140 positioned proximate to the drive unit 64, is routed or rotated around one of the right-most lower pulley 56*d*, is then routed or rotated around the right upper pulley 52*b*, and is then coupled to the right bracket 60*b*. The turn buckle 136 is disposed on the second cable 128 between the left bracket 60*a* and the left-raised lower pulley 56*b*. The third cable 132 is coupled to the right bracket 60*b*, is routed or rotated around the right-raised lower pulley 56*c*, and is then coupled to the first drum 104. The turn buckle 136 is disposed on the third cable 132 between the right bracket 60*b* and the right-raised lower pulley 56*c*. The turn buckles 136 allow the tension on the cables 124, 128, 132 to be increased or decreased as needed. In an alternative embodiment only one cable is used instead of three cables, the one cable following the route of the three cables from the second drum 108 to the first drum 104. In yet another alternative embodiment the cables 124, 128, 132 are removably coupled to the brackets 60 using lock nuts, latches, movable crimpers or the like such that the cables 124, 128, 132 can be easily removed from the brackets 60 in order to perform maintenance on the window 20 and/or operate the window 20 manually.

The controller 68 is coupled to the sill 48, proximate to the drive unit 64. In some embodiments the controller 68 is coupled to the frame 28, while in other units the controller 68 is not mechanically coupled to the window 20. The controller 68 is electrically coupled to the wall switch 144 and is also electrically coupled to the motor 88. The controller 68 may receive electrical power from the wall switch 144, or in other embodiments it may be electrically coupled to a power outlet. In turn, the wall switch 144 and/or power outlet can be connected or electrically coupled to an external power grid and thus, receive power from the external power grid to open and close the window. In some embodiments the controller 68 includes a converter to convert alternating current electricity to direct current electricity. The wall switch 144 includes a neutral position, a position to open the window, and a position to close the window. In some embodiments, the wall switch 144 includes a programming interface such that the wall switch 144 can serve to program the controller 68 to open and/or close the window 20 at specified times and/or temperatures. The controller 68 may also receive commands wirelessly such as from a remote control, smartphone, internet communication device, or the like. The controller 68 is able to command the motor 88 to turn in a direction in order to open the window 20, to turn in the opposite direction in order to close the window 20, and to stop turning.

The controller 68 in the illustrated embodiment also includes obstacle detection logic. The controller 68 monitors the rotational rate of the motor 88 by reading the output from the Hall effect sensor 112. The Hall effect sensor 112 is electrically coupled to the controller 68. A preset motor turning speed range is programmed into the controller 68. If the motor 88 turns at a speed that is outside of the preset speed range, then the controller 68 commands the motor 88 to stop turning. If the sash 40 contacts a child, a pet, or some other object in its path, the turning speed of the motor 88 will decrease. The decrease in turning speed (monitored by the Hall effect sensor 112) alerts the controller 68 that there is an object in the way, and the controller 68 tells the motor 88 to stop turning. In some embodiments the controller 68 commands the motor 88 to turn in the opposite direction when an object is encountered. In yet other embodiments the controller 68 commands the motor 88 to attempt the same movement after a set interval of time has passed. In an alternative embodiment an obstacle sensor is disposed proximate the sash 40 and communicates with the controller 68 to alert that controller 68 when an obstacle is sensed.

In the illustrated embodiment the motor 88 is configured to inhibit turning when power is not applied to the motor 88. Thus if a burglar attempts to manually open the window 20, the cable system 66 and drive unit 64 inhibit the window 20 from opening. In an alternative the wall switch 144 includes an "emergency" button to allow the window 20 to be manually opened in an emergency. The emergency button sends an input to the controller 68, and the controller 68 sends a command to the motor 88 to allow the motor 88 to freewheel so that the window 20 may be manually opened. In another alternative embodiment an "emergency" lever is disposed on the sill 48. The emergency lever is configured to move the spur gear 96 or one of the series of gears 100 so that the drums 104, 108 are decoupled from the motor 88 when the emergency lever is thrown. Thus when the emergency lever is thrown the drums 104, 108 are able to freewheel, allowing the window 20 to be manually opened.

In an alternative embodiment an electric deadbolt is disposed in the sash 40 of the window 20 for extra security. The deadbolt is electrically coupled to the controller 68. If the window 20 is closed, the controller 68 commands the deadbolt to move to a "locked" position wherein the deadbolt enters a recess on the frame 28, the deadbolt thus preventing the sash 40 from moving relative to the frame 28. When the deadbolt is in an "unlocked" position then the deadbolt does not enter into the recess on the frame 28, thus allowing the sash 40 to be moved relative to the frame 28. In yet another alternative embodiment the deadbolt includes a manual lever so that the deadbolt may be moved to an "unlocked" position in case of an emergency or loss of power.

Figure 4A:
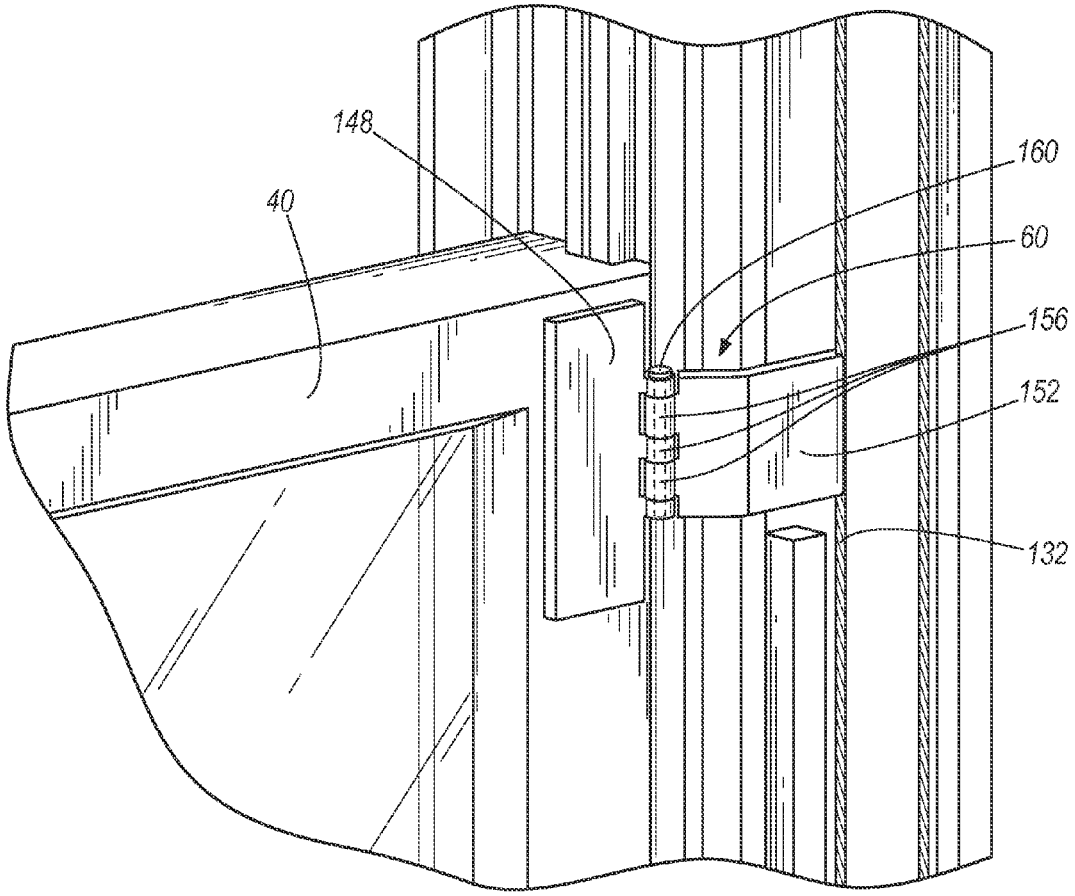
FIG. 4*a* is a perspective view of the window of FIG. 1 and an alternative embodiment of the bracket of the window power actuator of FIG. 1.

An alternative embodiment of the bracket 60 is illustrated in FIG. 4*a*. The bracket 60 includes two pieces, a sash piece 148 and a cable piece 152. The sash piece 148 is coupled to the sash 40. The cable piece 152 is coupled to the cable 132. The sash piece 148 includes at least one loop 156 and the cable piece 152 includes at least one loop 156. When aligned properly, the cable piece 152 fits into an opening on the sash piece 148. A pin 160 fits through the at least one loop 156 in order to couple the sash piece 148 to the cable piece 152. The sash piece 148 and cable piece 156 are configured such that when the cables 124, 128, 132 move, the cable piece 152 exerts a force on the sash piece 148 thus moving the window 20. The pin 160 may be removed from the at least one loop 156 to decouple the sash piece 148 from the cable piece 152. Thus if maintenance needs to be performed on the window 20, such as cleaning and the sash 40 needs to be tilted out of the frame 28, the cables 124, 128, 132 do not inhibit the sash 40 from moving when the cable piece 152 is decoupled from the sash piece 148. In case of a loss of power, an emergency, or some other reason why the window 20 would need to be opened or closed manually, the sash piece 148 may be decoupled from the cable piece 152 thus allowing the window 20 to be opened or closed manually.

Thus, the invention provides, among other things, a window power actuator.

What is claimed is:

1. A power actuator for a window in a building, the power actuator comprising:

a drive unit positioned within a sill of the window and including a motor;

a cable system engagable with the drive unit for moving a pane of the window relative to a window frame between an opened position and a closed position;

a controller electrically coupled to the drive unit and a power outlet located in the building; and a pulley positioned opposite of the sill of the window and the closed position of the pane of the window, wherein the cable system includes first and second cables driven by the motor, and two drums turnable in opposite directions and disposed next to one another in the sill of the window, wherein the first drum has a gear portion driven by a spur gear of the drive unit and directly engaged with a gear portion of the second drum, wherein the first cable winds about the first drum in a manner proportional to the second cable unwinding from the second drum, and wherein the first cable extends from the first drum in a direction opposite of the second cable extending from the second drum.

2. The power actuator of claim 1, wherein the first and second cables extend in a length direction of at least a portion of a distance between the drive unit and the pane of the window.

3. The power actuator of claim 2, wherein the first and second cables are rotatably driven by the motor to move the pane of the window relative to the window frame between the opened and closed positions.

4. The power actuator of claim 2, wherein the pulley is attached to the window frame.

5. The power actuator of claim 4, wherein the pulley is configured to allow a portion of the first cable to rotate thereabout when the pane of the window is moved relative to the window frame between the opened and closed positions.

6. The power actuator of claim 2, wherein the motor is electrically coupled to the controller and drives the first and second cables in first and second directions, thereby moving the pane of the window relative to the window frame between respective open and closed positions.

7. A power window assembly comprising:

a window having a sash movable between an opened position and a closed position;

a drive unit including a motor;

a first pulley fixed to a frame of the window and positioned within a sill of the window;

a second pulley positioned opposite the sill of the window and the closed position of the sash; and a cable system including a first cable engagable with the first and second pulleys, drivable by the motor, and extending in a length direction at least a portion of a distance between the sash and the sill of the window, wherein the cable system further includes a second cable and two drums turnable in opposite directions and disposed next to one another in the sill of the window, wherein the second drum has a gear portion directly driven by a gear portion of the first drum, wherein the first and second cables are moveable to drive the sash between the opened and closed positions, wherein the first cable winds about the first drum in a manner proportional to the second cable unwinding from the second drum, and wherein the first cable extends from the first drum in a direction opposite of the second cable extending from the second drum.

8. The power window assembly of claim 7 further comprising a controller electrically coupled to a power outlet when the window is located in a building.

9. The power window assembly of claim 8, wherein a wall switch located in the building is configured to electrically couple the controller and power outlet.

10. The power window assembly of claim 8, wherein the controller is configured to receive power from the power outlet, thereby rotating the first and second cables and moving the sash of the window between the open and closed positions.

11. The power window assembly of claim 8, wherein the drive unit is electrically coupled to the controller and the motor drives the first and second cables to move the sash of the window between the open and closed positions.

12. The power window assembly of claim 11, wherein the drive unit is disposed in an interior space of the window.

13. The power window assembly of claim 7, wherein a portion of the first cable is rotatable about the second pulley to move the sash of the window between the open and closed positions.

* * * * *